US007354071B2

(12) United States Patent
Mattos

(10) Patent No.: US 7,354,071 B2
(45) Date of Patent: Apr. 8, 2008

(54) METHOD AND APPARATUS FOR RETAINING AN ARTICLE IN A PHOTO BOOK

(75) Inventor: Lesley J. Mattos, San Francisco, CA (US)

(73) Assignee: Adesso Albums, Inc., San Francisco, CA (US)

( * ) Notice: Subject to any disclaimer, the term of this patent is extended or adjusted under 35 U.S.C. 154(b) by 346 days.

(21) Appl. No.: 10/306,489

(22) Filed: Nov. 27, 2002

(65) Prior Publication Data

US 2003/0127845 A1 Jul. 10, 2003

Related U.S. Application Data

(60) Provisional application No. 60/335,150, filed on Nov. 30, 2001.

(51) Int. Cl.
*B42D 1/00* (2006.01)

(52) U.S. Cl. ..... 281/38; 281/22; 281/33

(58) Field of Classification Search ..... 281/15.1, 281/21.1, 22, 36, 37, 38
See application file for complete search history.

(56) References Cited

U.S. PATENT DOCUMENTS 875,545 A * 12/1907 MacDonald ..... 40/537
1,719,648 A * 7/1929 Browne ..... 206/321
3,797,152 A * 3/1974 Brandt ..... 40/774
4,965,948 A * 10/1990 Ruebens ..... 40/537
5,082,312 A * 1/1992 Arrowood ..... 283/67
5,301,445 A * 4/1994 Hoffmeister ..... 40/537
5,509,746 A * 4/1996 Ho ..... 402/79
5,603,528 A * 2/1997 Chen ..... 281/33
5,639,172 A * 6/1997 Erickson ..... 402/79
5,788,283 A * 8/1998 Adler ..... 281/38
5,816,730 A * 10/1998 Alspaw et al. ..... 402/79
5,909,897 A * 6/1999 Lu ..... 281/22
5,918,394 A * 7/1999 Babcock ..... 40/122
5,954,518 A * 9/1999 Teichberg ..... 434/404
D421,049 S * 2/2000 Candelaria et al. ..... D19/26
6,210,172 B1 * 4/2001 Clements ..... 434/428
6,325,419 B1 * 12/2001 Benneman ..... 281/22
6,390,507 B1 * 5/2002 Derraugh et al. ..... 281/15.1
6,540,260 B1 * 4/2003 Tan ..... 281/22
6,544,037 B2 * 4/2003 Fink ..... 434/162
6,607,215 B2 * 8/2003 Nomura ..... 281/22
6,926,307 B2 * 8/2005 Mathews-Lingen ..... 281/22

* cited by examiner

*Primary Examiner*—Dana Ross
(74) *Attorney, Agent, or Firm*—Patterson & Sheridan, LLP

(57) ABSTRACT

The present invention generally relates to a method and apparatus for retaining an article and particularly to a book for retaining photographs. More particularly, the invention relates to a photo guest book where the photographs can be placed in the photo guest book as they are taken and the subject of the photograph can contemporaneously write a description adjacent the photograph as it relates to the photograph or as it relates to the event. A window for viewing the photograph is disposed on one or more of the bound page(s), and a writing space is disposed adjacent the window. A slot is formed on the bound page whereby the photo can be inserted through the slot and into the window.

22 Claims, 1 Drawing Sheet

METHOD AND APPARATUS FOR RETAINING AN ARTICLE IN A PHOTO BOOK

CROSS-REFERENCE TO RELATED APPLICATIONS

This application claims benefit of U.S. provisional patent application seriel No. 60/335,150 filed Nov. 30, 2001, which is herein incorporated by reference.

BACKGROUND OF THE INVENTION

1. Field of the Invention

Embodiments of the present invention generally relate to a method and apparatus for retaining an article and particularly to a book for retaining photographs. More particularly, the invention relates to a photo guest book wherein photographs can be placed in the book as they are taken and a written description of the photograph or of the event can be added contemporaneously.

2. Description of the Related Art

Photo albums have been around for a long time. The advent of photographic film changed the way people live and the way they remember personal, social and historic events. For well over a century, people have been taking photos of everyday life, including birthdays, social events, graduations, weddings and holidays, and placing them in some sort of book for safekeeping and future viewing. The photo books have evolved into very elegant hand crafted books not only used for the everyday photos but also for very specific events.

Some of the problems encountered with today's photo albums include remembering details about the occasions, people and places that are the subject of the photos. For example, there are many instances when numerous photos are taken at a party and after developing the photos, the owner of the photographs may not remember the identity of the people or places or remember the significance of an activity captured in the photo. An age-old solution to the problem included notation on the back of a developed photo, but these are not made contemporaneously with the event and are therefore often inaccurate. Another problem associated with the prior art photo books is that once the book is filled with photos, the overall size of the book is increased in thickness due to a stacking effect of the relatively thick photograph paper. In addition, the increased size tends to breakdown the book over time.

Therefore, there exists a need for a method and apparatus that can retain a photo in a photo book while permitting a written note to be contemporaneously added to the book near the photo. There is a further need for a method and apparatus for retaining a photo in a book so that the overall thickness of the photo book does not increase as the photo book is filled with photos.

SUMMARY OF THE INVENTION

The present invention generally relates to a method and apparatus for retaining an article and particularly to a book for retaining photographs. More particularly, the invention relates to a photo guest book where the photographs can be placed in the photo guest book during the course of the event and the subject of the photograph can contemporaneously write a description adjacent the photograph as it relates to the photograph or as it relates to the event. The photograph may be a POLAROID™ photograph that develops within moments of being taken or a digital photograph that is printed immediately or at a later time. In one embodiment, a book for retaining an article comprises a first cover and a second cover with one or more pages bound together and disposed in between the first and second covers. In addition, a window for a photograph is disposed on one or more of the bound page(s), and a writing space is disposed adjacent the window. A slot is formed on the bound page whereby the photo can be inserted through the slot and into the window. The pages of the photo book are constructed so that the thickness of each of the bound page(s) is such that inserting the photograph into the window will not increase the overall thickness of the page or the book.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
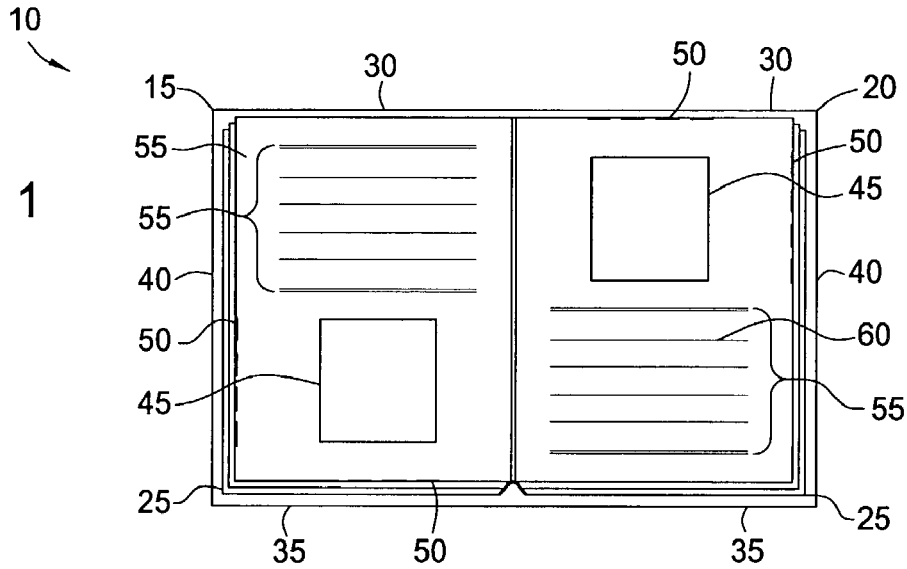
FIG. 1 is a view of the photo guest book of the present invention showing the guest book in an open position with a window for a photo and a writing space above or below the window.
Figure 2:
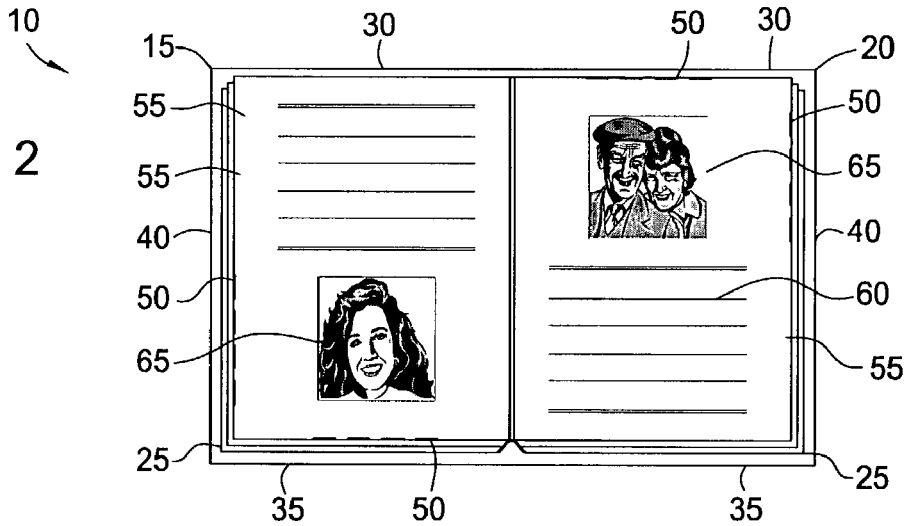
FIG. 2 is a view of FIG. 1 with a photo placed in the window of both pages.
Figure 3:
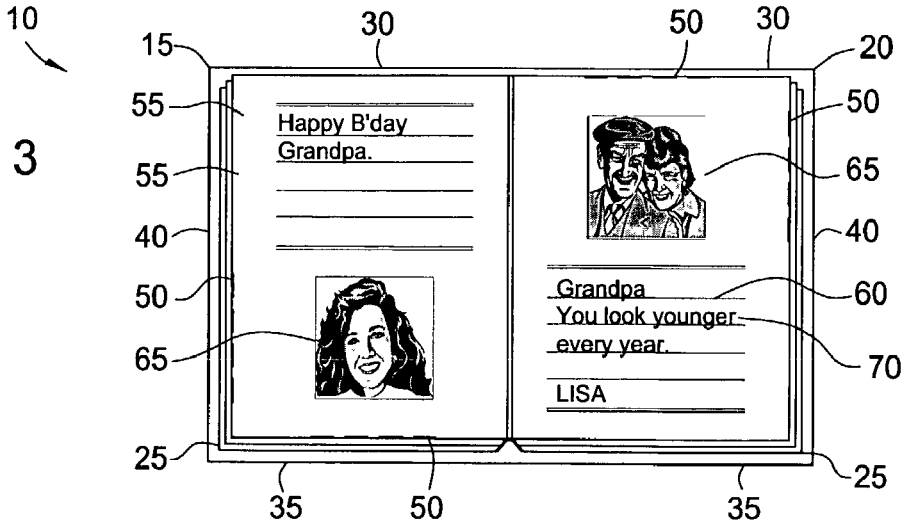
FIG. 3 is a view of the photo book of FIG. 2 with a note written in the writing space adjacent each photo.

The present invention includes a method and apparatus for retaining and displaying a photograph in a photo album with a writing space provided adjacent the photo. The writing space is included on each page along with a photo window so that a photo can be taken and placed in the photo guest book and a note or inscription can be contemporaneously written in the space adjacent the photo. The writing space can also be on a completely separate page (not shown) from the photo. Contemporaneously, as used herein, means originating, existing or happening during a relatively short time before or after an event. FIG. 1 is a front view of a photo guest book 10 in an open position with a first cover 15 and a second cover 20. Disposed between the covers 15, 20 are one or more page(s) 25. The pages 25 are held between the covers 15, 20 in a manner using adhesives or spiral binding well known to those in the book binding business. Also shown in FIG. 1, a window 45 is provided so a photo 65 (as shown in FIG. 2) may be inserted into window 45 after it has been taken. The photo 65 (as shown in FIG. 2) may be inserted into window 45 through a slot 50 (shown as dotted lines) disposed on one or more of the bound page(s) 25 either above window 45, below window 45 or to the side of window 45 depending how window 45 is positioned on bound page(s) 25. FIGS. 1, 2 and 3 also show a writing space 55 comprising either an open space (not shown) or one or more pre-printed lines 60 for writing an inscription or note about the photo, event, etc. The writing space 55 is positioned either directly above window 45, directly below window 45, or to the side of window 45 depending on how window 45 is positioned on the one or more bound pages 25.

The writing space can also be on a completely separate page (not shown) from the photo. The bound page(s) 25 are constructed so that each page is of a double thickness such that inserting a photograph 65 (shown in FIG. 2) into window 45 will not increase the overall thickness of each page 25 of the entire guest book 10.

In operation, as shown in FIGS. 1, 2 and 3, photo guest book 10 is opened so that first cover 15 and second cover 25 are laying flat, leaving bound page(s) 25, window 45 and writing space 55 displayed. A photo 65 is taken, for example, of some friends invited to a birthday party. As a recently taken photo is developing or after it is printed the photo 65 can be inserted through slot 50 into window 45 until the photo is positioned completely inside window 45 and is completely visible from the outside. Once photo 65 is positioned in window 45, an inscription or note 70 can be written in writing space 55 on one or more of the preprinted lines 60. All of the above steps can be performed contemporaneously. The method can then repeated until all of the windows 45 and writing spaces 55 disposed on bound page(s) 25 are filled with photos 65 and inscriptions or notes 70 respectively. As one skilled in the art, it is apparent that the method in which the photo guest book 10 is completed can be done in a variety of ways. For example, photo 65 could be taken, inscription or note 70 could be written into writing space 55 and photo 65 could then be inserted through slot 50 into window 45. Another variation may proceed by writing an inscription or note 70 into writing space 55, taking a photo 65, and then inserting this photo 65 through slot 30 and into window 45.

In another embodiment, the photo book may have a window on one or more of the pages and a writing space on a completely separate page. In addition, the writing space may not comprise any pre-printed lines.

While the foregoing is directed to embodiments of the present invention, other and further embodiments of the invention may be devised without departing from the basic scope thereof, and the scope thereof is determined by the claims that follow.

The invention claimed is:

1. A book for retaining an article comprising:

a first cover;

a second cover;

one or more pages bound together and disposed between the first and second covers, each page having a first sheet, a second sheet opposite the first sheet and defining a space therebetween, the second sheet having substantially the same dimensions as the first sheet and wherein each page has a perimeter edge comprising a perimeter of the first sheet and a perimeter of the second sheet and at least one slot at the perimeter edge thereof, the slot constructed and arranged to receive the article;

at least one window formed in at least one of the sheets;

whereby an article is insertable through the at least one slot into the space to be viewable through the window;

a writing space disposed adjacent the at least one window; and wherein a thickness of each page is such that inserting the article into the window will not increase the thickness of the pages or the book.

2. The book of claim 1, wherein the article is a photo.

3. The book of claim 1, wherein the window is positioned on a top half of at least one page.

4. The book of claim 1, wherein the window is positioned on a bottom half of the at least one page.

5. The book of claim 1, wherein the writing space comprises one or more pre-printed lines.

6. The book of claim 5, wherein the writing space is positioned within one half of the page adjacent the window.

7. The book of claim 1, wherein a length and a width of the at least one slot at the perimeter are at least the same as a thickness and a height of the article.

8. A book for retaining an article comprising:

a first cover;

a second cover;

one or more pages bound together and disposed between the first and second covers, each page having a first sheet, a second sheet opposite the first sheet and defining a space therebetween, wherein the first sheet and second sheet are substantially the same size and wherein each of the one or more pages has a perimeter edge comprising a perimeter of the first sheet and a perimeter of the second sheet, the space accessible to the article from a slot located on at least one perimeter edge of the page, wherein a thickness of each page is such that inserting the article into the space will not increase the thickness of the pages or the book; and at least one window formed in at least one of the sheets providing visual access to the space.

9. The book of claim 8, further includes a writing space.

10. The book of claim 9, wherein the writing space is disposed adjacent the at least one window.

11. The book of claim 9, wherein the writing space comprises one or more pre-printed lines.

12. The book of 9, wherein the writing space is positioned within one half of the page adjacent the window.

13. The book of claim 8, wherein the article is a photo.

14. The book of claim 8, wherein the window is positioned on a top half of at least one page.

15. The book of claim 8, wherein the window is positioned on a bottom half of at least one page.

16. The book of claim 8, wherein the article is insertable into the space.

17. A method of retaining a photo comprising:

taking a photo;

inserting the photo into a space defined between a first sheet and a second sheet of a page by utilizing a slot formed at a perimeter edge of the page wherein the first sheet and second sheet are substantially the same size and wherein the perimeter edge of the page comprises a perimeter of the first sheet and a perimeter of the second sheet; and wherein the photo is viewable through a window formed in at least one of the sheets, and wherein a thickness of each page is such that inserting the photo into the window will not increase the thickness of the page or of the book.

18. The method of claim 17, further comprising writing on the page adjacent the window.

19. The method of claim 17, further comprising writing on the page adjacent the window during and/or a short time after an event.

20. The method of claim 19, wherein the event is a wedding.

21. A method for retaining an article in a book comprising:

providing a first cover and a second cover;

binding one or more pages between the first and second covers each page having a first sheet, a second sheet opposite the first sheet and defining a space therebetween, the second sheet having substantially the same dimensions as the first sheet and wherein each page has a perimeter edge comprising a perimeter of the first sheet and a perimeter of the second sheet and at least one slot at the perimeter edge thereof, wherein the slot is constructed and arranged to receive the article;

inserting the article through the slot;

positioning the article in the space;

writing a message adjacent at least one window; and viewing the article through the at least one window formed in at least one of the sheets.

22. The method of claim 21, further comprising not increasing the thickness of the page or the book when inserting the article.

* * * * *